US008985181B2

(12) United States Patent
Hsieh

(10) Patent No.: US 8,985,181 B2
(45) Date of Patent: Mar. 24, 2015

(54) MACHINE MECHANISM OF A ROLLING DOOR OPERATOR

(71) Applicant: Chung Hsien Hsieh, New Taipei (TW)

(72) Inventor: Chung Hsien Hsieh, New Taipei (TW)

( * ) Notice: Subject to any disclaimer, the term of this patent is extended or adjusted under 35 U.S.C. 154(b) by 142 days.

(21) Appl. No.: 13/874,356

(22) Filed: Apr. 30, 2013

(65) Prior Publication Data

US 2014/0318719 A1 Oct. 30, 2014

(51) Int. Cl.

| | |
|---|---|
| ***A47G 5/02*** | (2006.01) |
| ***E05F 15/20*** | (2006.01) |
| ***A62C 2/24*** | (2006.01) |
| ***E06B 9/42*** | (2006.01) |

(52) U.S. Cl.

CPC ..... *E05F 15/2015* (2013.01); *A62C 2/247* (2013.01); *E06B 9/42* (2013.01)

USPC ..... 160/310; 160/321; 160/133; 49/139

(58) Field of Classification Search

USPC ..... 160/133, 188, 193, 293.1, 307, 321; 49/139, 140, 199; 192/141; 74/625

See application file for complete search history.

(56) References Cited

U.S. PATENT DOCUMENTS

| | | | | |
|---|---|---|---|---|
| 5,203,392 | A | 4/1993 | Shea | |
| 5,245,879 | A | 9/1993 | McKeon | |
| 5,355,927 | A | 10/1994 | McKeon | |
| 5,605,185 | A | 2/1997 | McKeon | |
| 5,893,234 | A | 4/1999 | McKeon | |
| 7,275,631 | B2 * | 10/2007 | Hsieh | 192/226 |
| 8,230,759 | B2 * | 7/2012 | Hsieh | 74/625 |
| 8,662,140 | B2 * | 3/2014 | Hsieh | 160/310 |
| 2010/0132505 | A1 * | 6/2010 | Hsieh | 74/625 |
| 2013/0247469 | A1 * | 9/2013 | Hsieh | 49/140 |
| 2014/0318719 | A1 * | 10/2014 | Hsieh | 160/133 |

* cited by examiner

*Primary Examiner* — Blair M Johnson

(74) *Attorney, Agent, or Firm* — Bui Garcia-Zamor; Jessica H. Bui, Esq.

(57) ABSTRACT

In a door operator having a driving end and a weight carrying end, an electric motor mechanism, a first electromagnetic clutch mechanism, a combination pull-chain disc and brake, a second electromagnetic clutch mechanism are disposed in sequence between the driving end and the weight carrying end, the mechanisms being connected by rotating shafts and a hollow shaft, in which when the electric motor mechanism is electrically powered, the first electromagnetic clutch mechanism moves the hollow shaft to separate from a brake device, and the second electromagnetic clutch mechanism connects the driving end to the weight carrying end; and when the electric motor mechanism is not electrically powered, the first electromagnetic clutch mechanism connects the hollow shaft to the brake device, and the second electromagnetic clutch mechanism separates the driving end from the weight carrying end.

7 Claims, 7 Drawing Sheets

MACHINE MECHANISM OF A ROLLING DOOR OPERATOR

BACKGROUND OF THE INVENTION

1. Field of the Invention

The present invention relates to a rolling door operator, and particularly to a machine mechanism of a rolling door operator for a fireproof rolling door, wherein a curtain of fire proof the rolling door can automatically fall down to close the fireproof rolling door in a power failure, or if necessary, for example, in an emergency escape, the fireproof rolling door can be opened by rotating a pull-chain disc through manually pulling a pull-chain.

2. Description of the Related Art

A so-called fireproof type of rolling door operator is used to close a fireproof rolling door immediately once in a power failure, no matter what causes the power failure. Even though a fire accident occurs in the case of no power failure, the power can be cut off by a fire control device, such as a smoke detector, a temperature sensor, other fire alarm detecting devices, or the like, so that a curtain of the fireproof rolling door can fall down to shut the fireproof rolling door based on its own weight. As a result, fire or smoke can be blocked from escape immediately at the first time when the fire accident occurs. This type of door operator generally does not install a manual pull-chain disc means, because the pull-chain disc means not only hinder the curtain of the fireproof rolling door to fall down freely, but also increases the complexity of the rolling door operator. However, in order to be adapted to an emergency escape or keep a personnel access in a power failure caused by a non-fire accident, this type of rolling door operator generally installs a back-up power for the benefit of opening the fireproof rolling door urgently. However, it is known to those skilled in the art that the back-up power should be maintained frequently to ensure that it is kept in a good condition ready to be used under an emergency.

It is known that a number of related patent documents, for example, U.S. Pat. Nos. 5,203,392, 5,245,879, 5,355,927, 5,605,185, and 5,893,234 have disclosed this type of rolling door operator for closing fireproof rolling doors.

On the other hand, rolling door operators according to their purposes and functions are generalized as a fireproof type of warehouse door, a safety type of commercial escape door and a standard type of general residence, etc. Each of the fireproof type, the safety type, and the standard type of rolling door operators is further classified into an electric type and a manual type. For a rolling door operator manufacturing industry, it must develop a number of types of rolling door operators having various control ways to meet requirements for different uses. Consequently, needed are a variety of production processes and more parts which renders stock cost and production cost relatively high.

SUMMARY OF THE INVENTION

A main objective of the present invention is to provide a rolling door operator for a fireproof rolling door capable of being manually implemented to open the fireproof rolling door in an emergency case, so that the disadvantage concerned with a rolling door operator for a prior art fireproof rolling door having no manual mechanism can be overcome.

To achieve the above objective and other objectives, the rolling door operator having the machine mechanism according to the present invention comprises a housing for accommodating an electric motor mechanism, a first electromagnetic clutch mechanism, a combination of pull-chain disc and brake, a second electromagnetic clutch mechanism, and a centrifugal brake mechanism in sequence, wherein the electric motor mechanism has a central rotating shaft to be rotated by the motor, and its rotation is transmitted to an output wheel fixed on an output shaft at least via a first rotating shaft and a second rotating shaft coupling to each other, and hence the output wheel rotates a winding shaft through, for example, a chain; a hollow shaft bears on the right side of the first rotating shaft to be slided axially thereon; the first electromagnetic clutch mechanism is fitted over the right side of the hollow shaft, and is controlled to separate the hollow shaft from the central rotating shaft when the electric motor mechanism rotates, or to connect them together when the electric motor mechanism stops rotating; the combination of pull-chain disc and brake, fitted over the first rotating shaft at a position between the two ends thereof, is comprised of a pull-chain disc device and a brake device; wherein the pull-chain disc device comprising a pull-chain disc, around which a pull-chain runs and inside which there is an axial space functioning as an accommodating portion for accommodating the brake device therein, and wherein the braking device being located on the left side of the hollow shaft and comprising a shaft hub secured on the housing, and one or more torsional springs being fitted over the shaft hubs in a way that when the torsional spring is twisted by a torsion force from the hollow shaft, the torsional spring is actuated to shrink its inner diameter and constrict the shaft hub, which results in the central rotating shaft being in a braking state; and when the torsional spring is actuated by rotating the pull-chain disc, its inner diameter is enlarged so as to loosen its constriction from the shaft hub, which results in the brake being released; and the second electromagnetic clutch mechanism is fitted over the first rotating shaft at the left side thereof and neighbors on the right side of the second rotating shaft, so that the first rotating shaft is constantly coupled with the second rotating shaft together.

According to the rolling door operator of the present invention, when a curtain of the fireproof rolling door is wound up to open the fireproof rolling door, at least part of the gravity weight of the curtain of the fireproof rolling door always acts on the output wheel which transmits to the hollow shaft and renders and hollow shaft to have a tendency to actuate on the torsional spring to shrink its inner diameter so as to stop the central rotating shaft from rotating, that is, the rolling door operator is in a brake state; and when an electric power is in failure, the second electromagnetic clutch mechanism will fail to make the first rotating shaft couple with the second rotating shaft, so that the curtain of fireproof the rolling door falls down freely to close the fireproof rolling door by its own weight. On the other hand, based on the fact that the second electromagnetic clutch mechanism is provided with an electrical energy storage device (for example, a small size battery) for controlling a coupling of the first rotating shaft with the second rotating shaft, the torsional spring can be actuated to enlarge its diameter by rotating the pull-chain disc with the pull-chain. Hence, the torsion spring brake is released with the hollow shaft to be allowed to rotate the central rotating shaft to open the fireproof rolling door for the purpose of an emergency escape.

According to the fireproof rolling door operator of the present invention, the electric motor mechanism and the combination of pull-chain disc and brake are detachably connected together by the first electromagnetic clutch mechanism. Hence, in the case of detaching the electric motor mechanism during maintenance, even in the case of the electric motor mechanism being out of order, the rolling door operator can still be operated to open/close the fireproof rolling door in a manual mode through the combination pull-chain disc and brake, to keep personnel normal access.

According to the rolling door operator of the present invention, each mechanism of the rolling door operator has good compatibility with each other in constructions. For example, if the electric motor mechanism and the first electromagnetic clutch mechanism are omitted from the rolling door operator, the rolling door operator becomes a manual rolling door operator. Also, for example, if the second electromagnetic clutch mechanism and the centrifugal braking mechanism are omitted from the rolling door operator, the fireproof rolling door operator becomes a general standard electric door operator. Furthermore, for example, if the electric motor mechanism, the first electromagnetic clutch mechanism, the second electromagnetic clutch mechanism, and the centrifugal brake mechanism are omitted from the rolling door operator, the rolling door operator becomes a general standard manual door operator. As such, without increase of extra cost, more types of rolling door operators with various control ways are constructed. Accordingly, the stock cost is also relatively reduced.

DESCRIPTION OF THE PREFERRED EMBODIMENTS

Hereinafter, the technical features of the present invention are further described in cooperation with embodiments. The embodiments are preferred examples only and are not used to limit the scope of implementation of the present invention. It is better understood from the following detailed description with reference to accompanying drawings.

Figure 1:
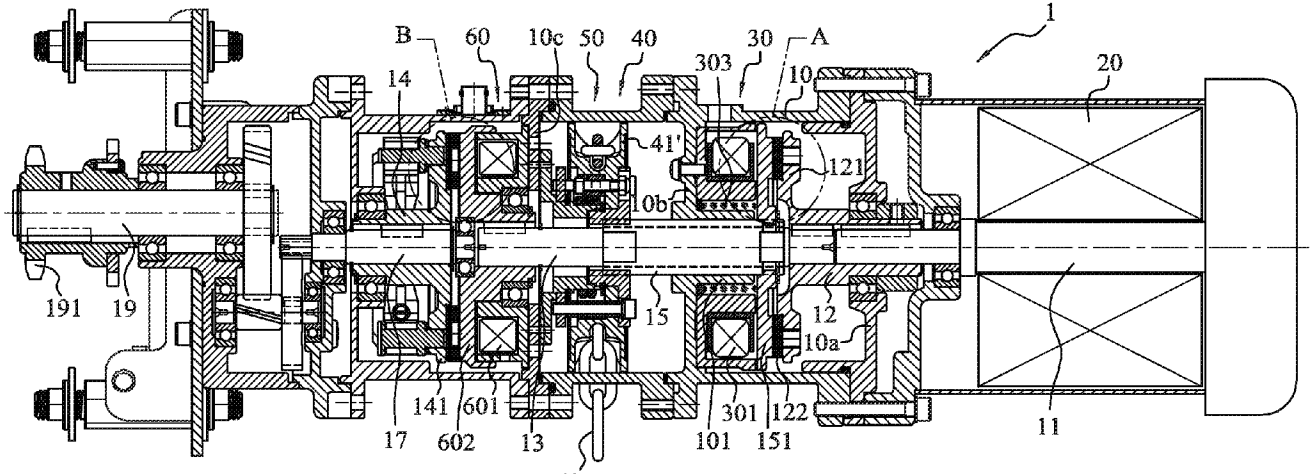
FIG. 1 is a cross-sectional view showing a machine mechanism of a rolling door operator of the present invention.
Figures 2, 2A, 2B:
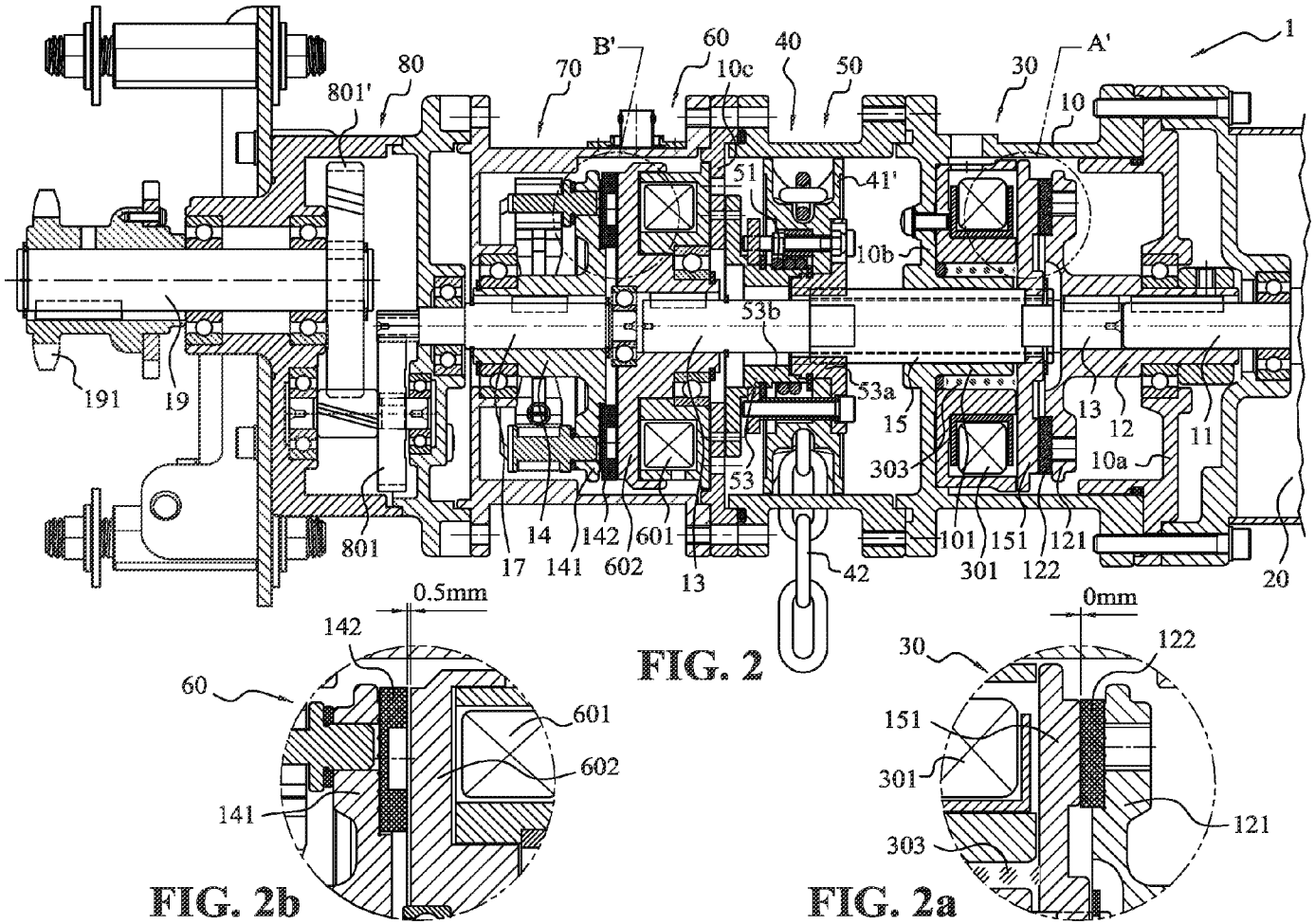
FIG. 2 is a partly enlarged cross-sectional view from FIG. 1, showing the machine mechanism of the rolling door operator of the present invention.
FIG. 2*a* is a partly enlarged view of a circled portion "A" in FIG. 2, showing that a first electromagnetic clutch mechanism is in a non-magnetically excited state (i.e. in a coupling state).
FIG. 2*b* is a partly enlarged view of a circled portion "B" in FIG. 2, showing that the second electromagnetic clutch mechanism is in a non-magnetically excited state (i.e. in a separate state).

First, please referring to FIGS. 1 and 2, a machine mechanism of a rolling door operator of the present invention is applied to an electric rolling door operator for a fireproof rolling door. The machine mechanism 1 of the rolling door operator according to the present invention is used to automatically unwind a curtain of the fireproof rolling door wound on a winding shaft (not shown) to close a door when electrical power is in failure. The machine mechanism is comprised of an electric motor mechanism 20, a first electromagnetic clutch mechanism 30, a combination of pull-chain disc and brake 40, a second electromagnetic clutch mechanism 60, which are accommodated in a housing 10. A first rotating shaft 13 passes through the first electromagnetic clutch mechanism 30, the combination pull-chain disc and brake 40, and the second electromagnetic clutch mechanism 60, in which a right end portion of the first rotating shaft 13 is detachably connected to a central rotating shaft 11 of the electric motor mechanism 20, and a left end portion f the first rotating shaft 13 is connected to a second rotating shaft 17 via the second electromagnetic clutch mechanism 60, so that mechanical turning induced from the electric motor mechanism 20 or manual turning induced from the combination pull-chain disc and brake 40 can be transmitted to an output shaft 19, and then the winding shaft (not shown) is rotated by an output wheel 191 fixed on the output shaft 19.

A hollow shaft 15 is slidably sleeved on the first rotating shaft 13 at a right side portion thereof. The first electromagnetic clutch mechanism 30 is disposed on a right side portion of the hollow shaft 15 over a periphery of the hollow shaft 15 and fixed to the housing 10. When the electric motor mechanism 20 is electrically powered, the first electromagnetic clutch mechanism 30 makes the hollow shaft 15 slide to separate from the central rotating shaft 11. After stopping electrically powering the electric motor mechanism 20, both of the central rotating shaft 11 and the hollow shaft 15 are connected to each other again.

The combination pull-chain disc and brake 40 is disposed over the first rotating shaft 13 between two ends of the first rotating shaft 13, and comprises a pull-chain disc device 41 and a brake device 50. The pull-chain disc device 41 comprises an end disc 531, to which a left end side of the hollow shaft 15 is axially and slidably connected. A pull-chain disc 41', which is supported on the end disc 531, can be rotated by a pull-chain 42 running on an outer periphery of the pull-chain disc 41', to drive the end disc 531 to rotate together with the hollow shaft 15. Inside the pull-chain disc 41', there is an axial, left end-opened, ring-like space as an accommodating portion 410. The brake device 50 is accommodated in this accommodating portion 410. The brake device 50 comprises a shaft hub 53 secured on the housing 10 and at least one torsional spring 51 bears on a circumference of the shaft hub 53. The torsional spring 51 can be twisted along with the rotation of the hollow shaft 15 and the end disc 531 to reduce its inner diameter so as to constrict the circumference of the shaft hub 53 and result in the central rotating shaft 11 in a brake state; or the torsional spring 51 can be detwisted by the rotation of the pull-chain disc 41' to enlarge its inner diameter so as to release the shaft hub 53 and result in the central rotating shaft 11 in a unbraked state.

The second electromagnetic clutch mechanism 60 is disposed and secured between the left side portion of the first rotating shaft 13 and a right side portion of the second rotating shaft 17, which is opposite to the first rotating shaft 13, and is used to constantly couple the first rotating shaft with the second rotating shaft together in normal power supply or make them separate in power failure.

A control circuit comprises an electric energy storage device (not shown), which is used to electrically power the second electromagnetic clutch mechanism 60 as a power is in failure.

So, in normal power supply, the rotation of the central rotating shaft 11 generated by the electric motor mechanism 20 is transmitted to the output shaft 19 and the output wheel 191, so that the curtain of the rolling door is wound around the winding shaft to open the door. Based on the fact that the weight of the curtain of the rolling door always acts on the output wheel 191 to actuate the torsional spring 51 through the hollow shaft 15 and the end disc 531, the inner diameter of the tossional spring 51 is reduced, and hence the torsional spring 51 always constricts the shaft hub 53, which results in keeping the central rotating shaft 11 in a brake state. However, in power failure state, the second electromagnetic clutch mechanism 60 makes the first rotating shaft 13 and the second rotating shaft 17 separate, so that the curtain of the rolling door falls down closed by the weight of the curtain of its own. And, in the case of emergency escape, the electric power energy device electrically powers the second electromagnetic clutch mechanism 60 to keep the first rotating shaft 13 couple the second rotating shaft 17. The torsional spring 51 can be actuated by rotating the pull-chain disc 41' with the pull-chain 42 to enlarge the inner diameter of the torsional spring 51, hence release its brake. Thereby, through a exertion of force on the pull-chain 42 for running the pull-chain disc 41', the hollow shaft 15 is rotated by the pull-chain disc 41, with the central rotating shaft 11 turned together, and such a rotation movement is transmitted through the first rotating shaft 13 and the second rotating shaft 17 to the output wheel 191 to wind up the curtain of the rolling door.

According the present invention, the housing 10 at least comprises a first partition plate 10*a*, a second partition plate 10*b*, and a third partition plate 10*c*, which are interposed between the electric motor mechanism 20 and the first electromagnetic clutch mechanism 30, between the first electromagnetic clutch mechanism 30 and the combination pull-chain disc and brake 40, and between the combination pull-chain disc and brake 40 and the second electromagnetic clutch mechanism 60, respectively. A first bush 12 axially holds the central rotating shaft 11 and the first rotating shaft 13 together. A right side portion of the first bush 12 is born on the first partition plate 10*a*, and a left side portion of the first bush 12 is formed with an end disc 121. A brake shoe 122 is secured on a left end face of the end disc 121.

The first electromagnetic clutch mechanism 30 comprises a first electromagnet 301, secured on the second partition plate 10*b* opposite to the end disc 121. On the second partition plate 10*b*, an axial guidance sleeve 101 is formed. An accommodating portion is formed for accommodating an elastic element 303 between an outer circumference of the guidance portion 101 and an inner circumference of the first electromagnet 301.

The hollow shaft 15 passes through the guidance sleeve 101 and is guided to be slidable axially. A brake disc 151 is secured on a right end portion of the hollow shaft 15 to the effect that it is located between the first electromagnet 301 and the end disc 121. The brake disc 151 is always exerted by the elastic element 303 to abut against the brake shoe 122 of the end disc 121 for the purpose that the hollow shaft 15 is coupled with the central rotating shaft 11. When the central rotating shaft 11 is rotated by the electric motor mechanism 20, the first electromagnet 301 is magnetically excited simultaneously, and the brake disc 151 is attracted to resist against the biasing force of the elastic element 303, so as to make the hollow shaft 15 slide to release the coupling of the brake disc 151 with the end disc 121 (referring to FIG. 1*a*). Hence, the hollow shaft 15 is separate from the central rotating shaft 11. At this time, the rotation of the central rotating shaft 11 can drive the first rotating shaft 13 directly. On the other hand, when the central rotating shaft 11 stops rotating, the first electromagnet 301 which is not magnetically excited now makes the hollow shaft 15 couple with the central rotating shaft 11 again (referring to FIG. 2*a*).

Figures 3, 3A, 3B, 3C:
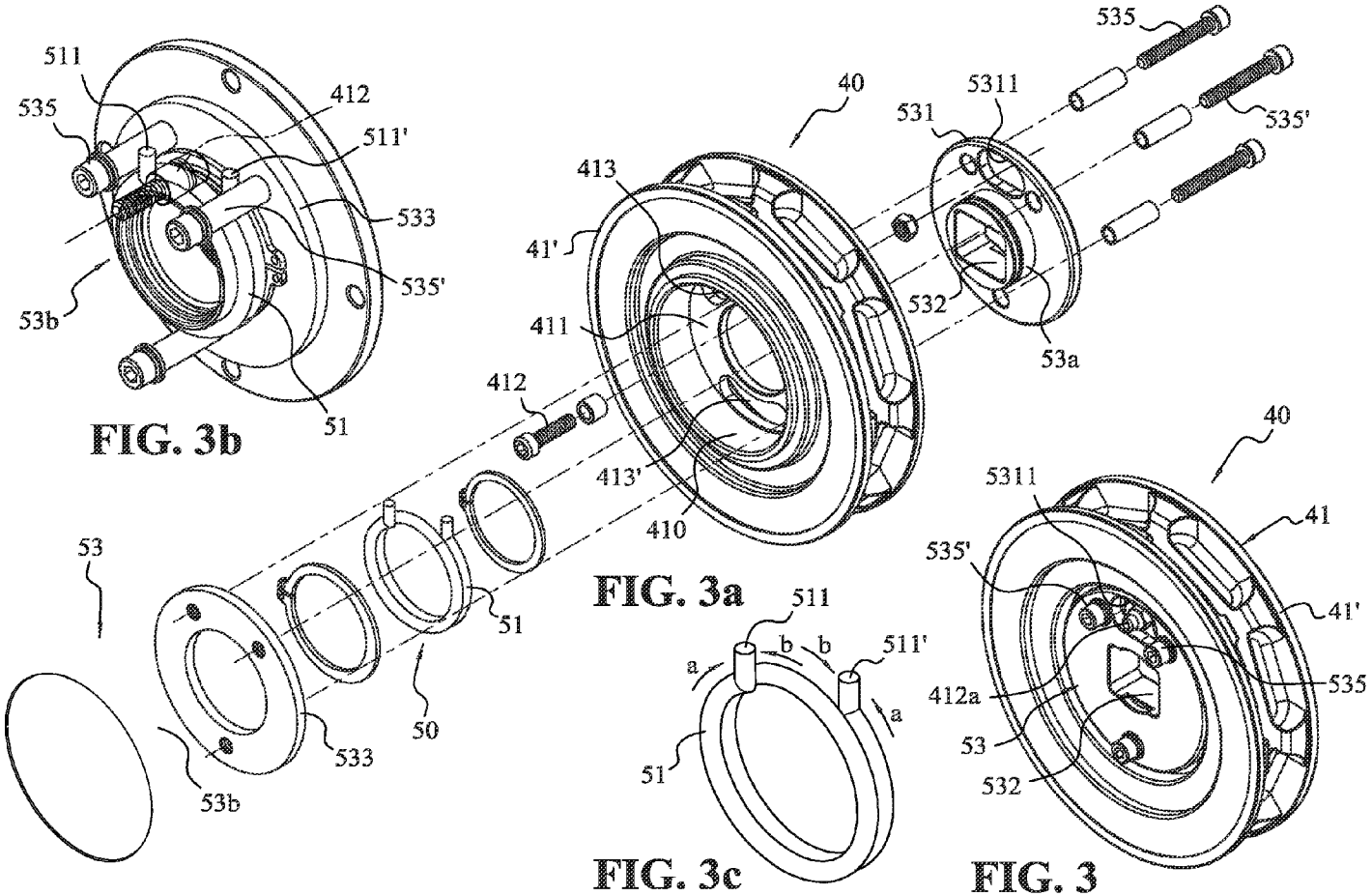
FIG. 3 is a perspective view showing a combination pull-chain disc and brake of the present invention, wherein other mechanisms are omitted.
FIG. 3*a* is a perspective view showing the combination pull-chain disc and brake of FIG. 3 in a separate state.
FIG. 3*b* is a perspective view showing a brake device of the combination pull-chain disc and brake of FIG. 3, from which a pull-chain disc is already detached.
FIG. 3*c* is a perspective view showing a torsional spring of the present invention.
Figure 4:
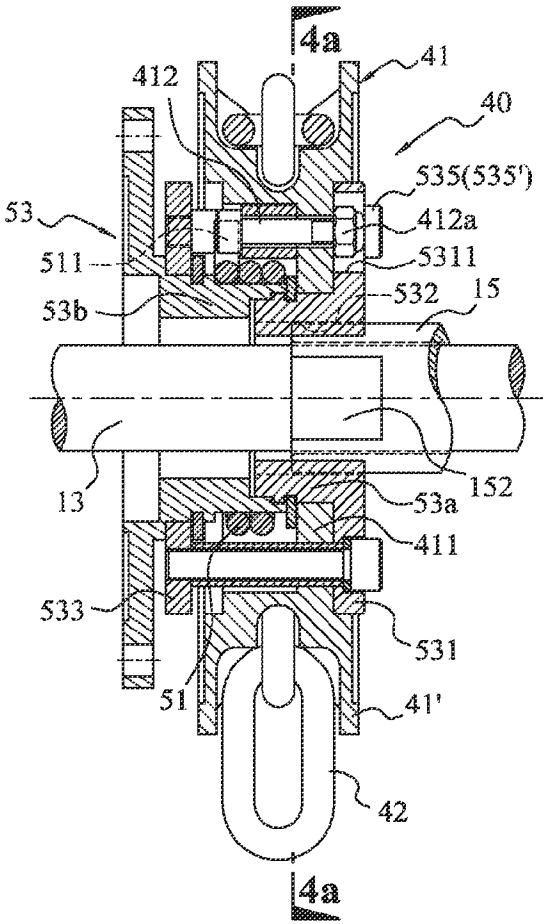
FIG. 4 is a cross-sectional view showing the combination pull-chain disc and brake of the present invention, wherein other mechanisms are omitted.
Figure 4A:
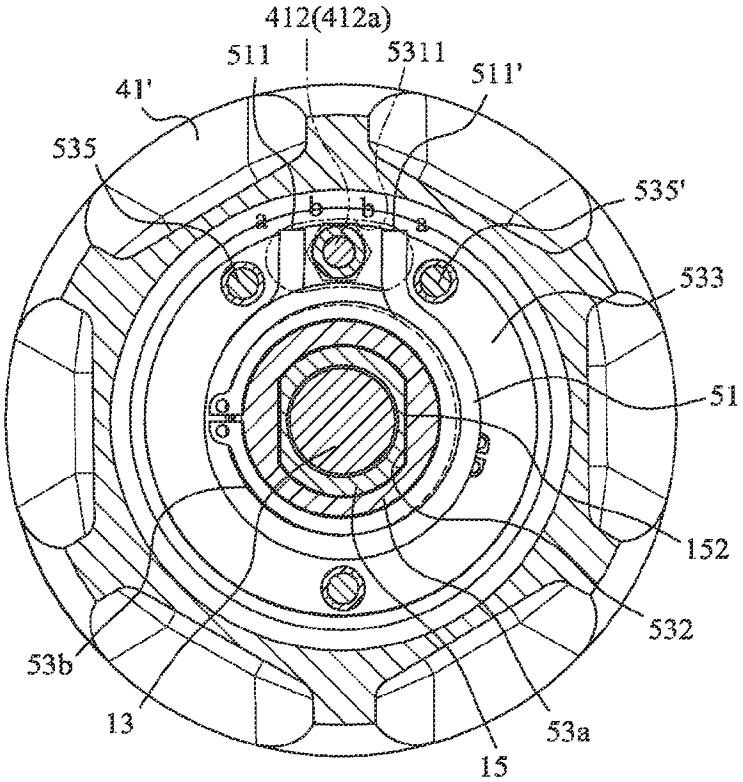
FIG. 4*a* is a cross-sectional view along line 4*a*-4*a* of FIG. 4.

Referring to FIGS. 3 to 4*a*, on a right side surface of the accommodating portion 410 of the pull-chain disc 41', there is a partition plate 411. A protrudent pin 412 is secured at a point of a predetermined radius on the partition plate 411. One left end of the protrudent pin 412 protrudes axially from the left side of the partition plate 411 into the accommodating portion 410, and the other end of the protrudent pin 412 extends from the right side of the partition plate 411 to form an extending end 412*a*. The hub 53 is comprised of a pair of inner hub 53*a* and outer hub 53*b*, wherein the inner hub 53*a* is pentrated the partition plate 411 and pivoted on it, and within the accommodating portion 410, the outer hub 53*b* is sleeved on the inner hub 53*a*. On a center portion of the inner hub 53*a*, there is a square match bore 532, and the left side end portion 152 of the hollow shaft 15 is shaped in a square shape, so that the square end 152 can be slidably engaged with the square match bore 532. The end disc 531 is located on the right side of inner hub 53*a* and opposite to the right side of the partition plate 411. On the end face of the end disc 531, there is a circular slot 5311 with a predetermined arc length which is formed at a predetermined radius correspondent to the radial position of the protrudent pin 412 in order to receive the extending end 412*a* in the circular slot 5311 (referring to FIGS. 3 and 4). The left side of the outer hub 53*b* is fixed on the third partition plate 10*c*. A movable disc 533 is pivoted on the outer hub 53*b* to rotate around it. The torsional spring 51 positioned at the right side of the movable disc 533 and constricts the outer hub 53*b*. The two ends of the torsional spring 51 are free ends, staggered with a predetermined distance and formed with two protrudent portions 511, 511', respectively, which protrude outwards in a radial direction. The protrudent portions 511, 511' have twisting direction sides "a" and detwisting direction sides "b", respectively (referring to FIG. 3*c*). A pair of bolt pieces 535, 535,' from the end disc 531 of the inner hub 53*a*, go through the partition plate 411 and pass by outsides of the two protrudent portions 511, 511' of the torsional spring 51 at predetermined positions which are outside the two ends of the circular slot 5311, respectively, and then are fixed on the movable disc 533. That is to say, the pair of bolt pieces 535, 535' are located opposite to the twisting direction sides "a" of the protrudent portions 511, 511', respectively, and the protrudent pin 412 is located between the detwisting direction sides "b" of the protrudent portions 511, 511' (referring to FIGS. 3*b* and 4*a*). Two through circular slots 413 and 413' corresponding to the bolt pieces 535 and 535' are formed to allow the bolt pieces 535 and 535' to pass through freely and function as moving paths for the bolt pieces 535 and 535' during their turning with the end disc 531 (referring to FIG. 3*a*).

Furthermore, as shown in FIGS. 1 and 2, the second electromagnetic clutch mechanism 60 comprised of a second electromagnet 601 is fixed on the third partition plate 10*c* in which a driving disc 602 is pivoted around the second electromagnet 601 at the left side thereof and fixed together with the left end portion of the first rotating shaft 13. A second bush 14 is secured to the second rotating shaft 17 between the two ends of the second rotating shaft 17, the right end of the second bush 14 is formed with a driven disc 141 facing to the driving disc 602, wherein a brake shoe 142 is located between the driving disc 602 and the driven disc 141. The brake shoe 142 is biased by an elastic plate 143 connected to the driven disc 141, so that the brake shoe 142 always comes into contact with the driven disc 14. A right end portion of the second rotating shaft 17 is pivoted on the driving disc 602, and a left end portion of the second rotating shaft 17 is connected to the output shaft 19 via a train of the gears 801, 801' of a speed reduction mechanism. In the case of normal power supply, the second electromagnet 601 is magnetically excited, and the brake shoe 142 is attracted to the driving disc 602 by resisting against the elasticity of the elastic plate 143, so as to make the first rotating shaft 13 and the second rotating shaft 17 constantly come into contact with each other (referring to FIG. 1*b*); in the other hand, in the case that the second electromagnet 601 is electrically powered off, the second rotating shaft 17 and the first rotating shaft 13 are separate from each other (referring to FIG. 2*b*), so that the curtain of the fireproof rolling door falls down by its own weight. Moreover, there is a centrifugal braking mechanism 70 disposed around the outer periphery of the second bush 14 for controlling the falling speed of the curtain. The centrifugal braking mechanism 70 is run along with the turning of the second bush 14, and hence a centrifugal force is accompanied. When the falling speed of the curtain is over a predetermined value, a friction force exerts on an inner surface against the housing 10 with an effect to limit the rotating speed of the second bush 14, and hence controls the falling speed of the rolling door.

According to the present invention, the above electric energy storage device (for example, a storage cell) has stored electric energy in peacetime.

Figure 1A:
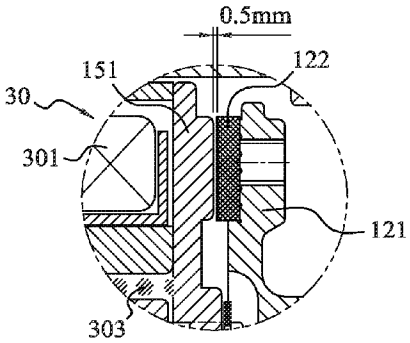
FIG. 1*a* is a partly enlarged view of a circled portion "A" in FIG. 1, showing that a first electromagnetic clutch mechanism is in a magnetically excited state (i.e. separate state).
Figure 1B:
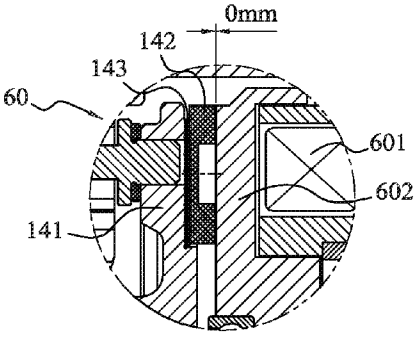
FIG. 1*b* is a partly enlarged view of a circled portion "B" in FIG. 1, showing that a second electromagnetic clutch mechanism is in a magnetically excited state (i.e. coupling state).

In the case of normal power supply, the control circuit controls the second electromagnet 601 of the second electromagnetic clutch mechanism 60 to be magnetically exited, hence the first rotating shaft 13 and the second rotating shaft 17 constantly connect each other (referring to FIG. 1*b*), as explained above; and after the electric motor mechanism 20 is rotated, it controls the first electromagnet 301 of the first electromagnetic clutch mechanism 30 to be magnetically excited simultaneously, so as to make the hollow shaft 15 separate from the central rotating shaft 11 (referring FIG. 1*a*). At this time, rotation of the central rotating shaft 11 is transmitted to the output shaft 19 via the first rotating shaft 13 and the second rotating shaft 17, and then the curtain of the fireproof rolling door is wound on the winding shaft by the output wheel 191, which is secured on the output shaft 19, so as to open the door, or dewound to close the door. When the electric motor mechanism 20 is switched off to stop rotating, the control circuit electrically switched off the first electromagnet 301 simultaneously. In this case, the first electromagnet 301 is magnetically deexcited, hence the biasing force of the elastic element 203 exerts the hollow shaft 15 on the central rotating shaft 11 to couple each other (as shown in FIG. 2*a*). At this time, as the fireproof rolling door being open, a torque generated by the weight of the curtain of the fireproof rolling door always acts on the output wheel 191 and is transmitted to the hollow shaft 15 via the output shaft 19, the second rotating shaft 17, the first rotating shaft 13, and the central rotating shaft 11, hence the inner hub 53*a*, which is engaged with the left side of the hollow shaft 15, has a rotation tendency. Since the two protrudent portions 511, 511' of the torsional spring 51 are located between the two bolt pieces 535 and 535', rotation of the inner hub 53*a* makes the bolt piece 535 (535') abut the twisting direction side "a" of the protrudent portions 511 (511') of the torsional spring 51 (as shown in FIG. 4*a*). The larger the tendency in the torsion direction is, the larger the force for constricting the torsional spring 51 on the outer hub 53*b* is, so that the hollow shaft 15 is in a brake state.

Furthermore, the control circuit becomes invalid immediately once in a power failure. That is, the second electromagnet 601 is not magnetically excited, the second electromagnetic clutch mechanism 60 releases the coupling of the first rotating shaft 13 with the second rotating shaft 17 (as shown in FIG. 2*b*). At this time, the curtain of the fireproof rolling door falls down by its own weight, so that fire or smoke is blocked from outside immediately. Furthermore, when emergency escape is needed after a fire alarm occurs, the fireproof rolling door can be opened again by rotating the pull-chain disc 41' via the manual pull-chain 42. In detail, in this manual operation, the electric energy storage device is controlled to electrically power the second electromagnetic clutch mechanism 60, so as to keep a coupling between the first rotating shaft 13 and the second rotating shaft 17. At this time, when the pull-chain disc 41' is rotated by the pull-chain 42, the protrudent pin 412 is rotated synchronously with the pull-chain disc. Since there is a predetermined gap between the extending end portion 412*a* of the protrudent pin 412 and a bottom end of the circular slot 5311 on the end disc 531 of the inner shaft hub 53*a*, after a force is exerted through the pull-chain 42 to rotate the pull-chain disc 41', the protrudent pin 412 fixed on the partition plate 411 at last will turn and actuate the protrudent portion 511 (511') of the torsional spring 51 in the detwisting direction side "b" to a effect that the inner diameter of the torsional spring 51 is enlarged and releases its brake on the outer shaft hub 53*b*. That is to say, the extending end portion 412*a* of the protrudent pin 412 turns and touches one of the bottom ends of the circular slot 5311 accordingly to exert and rotate the end disc 531 of the inner hub 53*a*, and to make the inner shaft hub 53*a* and the hollow shaft 15 rotate together. Hence, a rotation of the pull-chain disc 41' is transmitted to the output shaft 19 via the hollow shaft 15, the central rotating shaft 11, the first rotating shaft 13, the second rotating shaft 17. The curtain of the fireproof rolling door are wound on the winding shaft by the output wheel 191 fixed on the output shaft 19 (as shown in FIGS. 3 and 4*a*). Additionally, it is understood from the above description that in the case that the electric motor mechanism 20 is detached during maintenance or in the case that the electric motor mechanism 20 is out of work, the curtain of the fireproof rolling door can be opened/closed in a manual mode through the combination pull-chain disc and brake 40.

Figure 5:
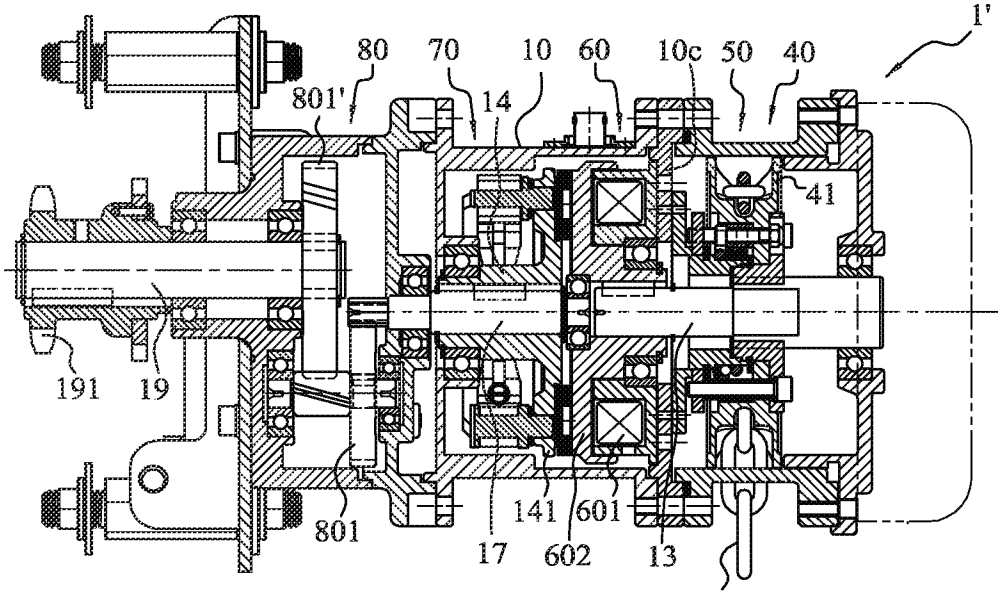
FIG. 5 is another modified example of a machine mechanism of a rolling door operator of the present invention, showing a manual rolling door operator for a fireproof rolling door.
Figure 6:
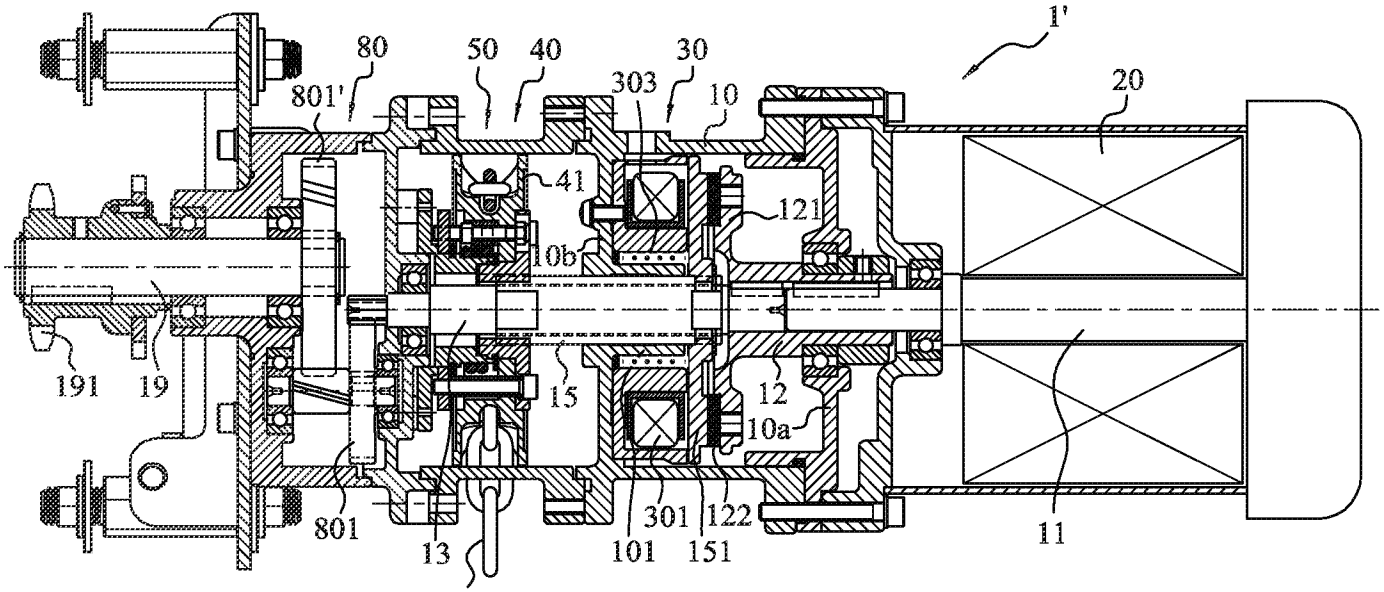
FIG. 6 is a further modified example of a machine mechanism of a rolling door operator of the present invention, showing a standard electric door operator.
Figure 7:
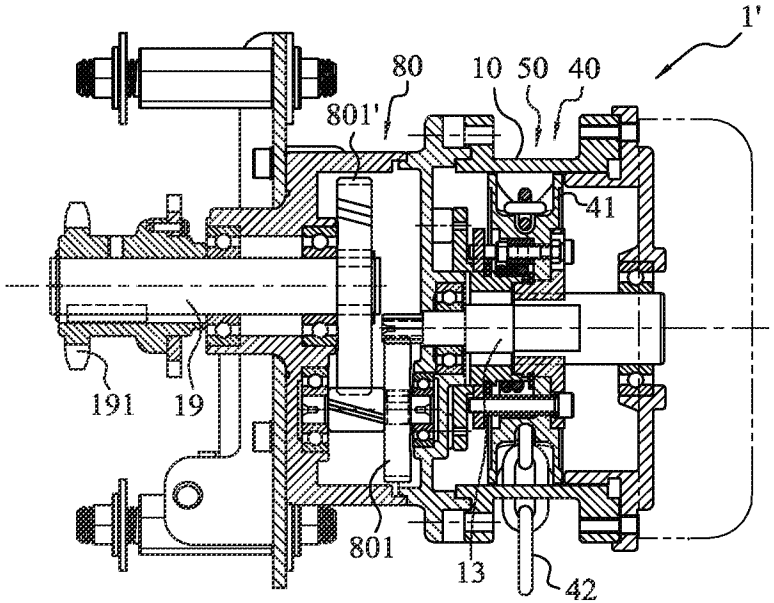
FIG. 7 is still a further modified example of a machine mechanism of a rolling door operator of the present invention, showing a standard manual rolling door operator.

The above description is just for the preferred embodiment of the machine mechanism 1 of the electric rolling door operator for the fireproof rolling door according to the present invention. It can be understood to those skilled in the art that other derivative embodiments can be obtained based on the machine mechanisms of the present invention. For example, as shown in FIG. 5, in the case of omitting the electric motor mechanism 20 and the first electromagnetic clutch mechanism 30, it becomes a manual door operator for a fireproof rolling door, wherein the machine mechanisms 1' comprises the housing 10 for defining an accommodating space, in which the combination pull-chain disc and brake 40, the second electromagnetic clutch mechanism 50, and the centrifugal braking mechanism 70, the speed reduction mechanism 80, etc. are accommodated in sequence. Furthermore, as shown in FIG. 6, in the case of omitting the second electromagnetic clutch mechanism 60 and the centrifugal brake mechanism 70, it becomes a non-fireproof type of general standard electric door operator, wherein the machine mechanisms 1' comprises the housing 10 for defining an accommodating space, in which the electric motor mechanism 20, the first electromagnetic clutch mechanism 30, the combination pull-chain disc and brake 40, the speed reduction mechanism 80, etc. are accommodated in sequence. Moreover, as shown in FIG. 7, in the case of omitting the electric motor mechanism 20, the first electromagnetic clutch mechanism 30, the second electromagnetic clutch mechanism 60, and the centrifugal braking mechanism 70, it becomes a non-fireproof type of general standard manual door operator, wherein the machine mechanisms 1' comprises the housing 10 for defining an accommodating space, in which the combination pull-chain disc and brake 40, the speed reduction mechanism 80, etc. are accommodated in sequence. In the case of no extra cost to be increased, more types of door operators with various control ways are able to be constructed by changing and exchanging the common components. Accordingly, not only is development cost low, production is simplified, parts are standardized and assembled easily, but also stock cost is relatively reduced. Therefore, the present invention is not limited to the disclosed embodiments. That is, equivalent changes and modifications without departing from the claims of the present invention should fall within the scope of the present invention.

What is claimed is:

1. A machine mechanism (1) of a door operator for automatically unwinding a curtain of a rolling door wound on a winding shaft in a power failure, the machine mechanism comprising an electric motor unit (20), a first electromagnetic clutch unit (30), a combination pull-chain disc and brake (40), and a second electromagnetic clutch unit (60), which are accommodated within a housing (10) in sequence, wherein:

a first rotating shaft (13) passes through the first electromagnetic clutch unit (30), the combination pull-chain disc and brake (40), and the second electromagnetic clutch unit (60), in which a right end of the first rotating shaft (13) is detachably connected to a left end of a central rotating shaft (11) of the electric motor unit (20);

a right end of a second rotating shaft (17) is connected to a left end of the first rotating shaft (13) via the second electromagnetic clutch unit (60), so that a torque from the electric motor unit (20) or the combination pull-chain disc and brake (40) is transmitted to an output shaft (19) through the first rotating shaft (13) and the second rotating shaft (17), an output wheel (191) being fixed on the output shaft (19);

a hollow shaft (15) slidably sleeves on a right side portion of the first rotating shaft (13), the first electromagnetic clutch unit (30) being disposed over a right side portion of the hollow shaft (15) to surround an outer periphery of the hollow shaft (15) and fixed to the housing (10), in which when the electric motor unit (20) is electrically powered, the first electromagnetic clutch unit (30) makes the hollow shaft (15) slide to separate from the central rotating shaft (11), and when the electric motor unit (20) is not electrically powered, the first electromagnetic clutch unit (30) makes the hollow shaft (15) slide to connect to the central rotating shaft (11);

an electric energy storage device is provided, for electrically powering the second electromagnetic clutch unit (60) in the power failure;

the combination pull-chain disc and brake (40) comprises a pull-chain disc device (41) and a brake device (50), in the pull-chain disc device (41) comprises a end disc (531) and a pull-chain disc (41'), the end disc (41) being connected with a left end of the hollow shaft (15) axially slidably, the pull-chain disc (41') being supported on the end disc (531) and rotated by a pull-chain (42) wound on an outer periphery of the pull-chain disc (41') for driving the end disc (531) to be rotated together with the hollow shaft (15); inside the pull-chain disc (41'), there is an axial, left end-opened annular space as an accommodating portion (410) for the brake device (50); and the brake device (50) comprises a shaft hub (53) secured on the housing (10) and at least one torsional spring (51) coils around the shaft hub (53);

the torsional spring 51 is actuated with a rotation of the hollow shaft (15) and the end disc (531) so as to shrink its inner diameter and constrict the shaft hub (53), resulting in the central rotating shaft (11) being in a brake state; or the torsional spring (51) is actuated by a rotation of the pull-chain disc (41') so as to enlarge its inner diameter and loosen the shaft hub (53), resulting in releasing the braking state; and the second electromagnetic clutch unit (60) comprises a second electromagnet (601), fixed on the housing (10); a driving disc (602), fixed at a left end portion of the first rotating shaft (13) and facing the second electromagnet (601); a second bush (14), secured on the second rotating shaft (17), a right end of the second bush (14) being formed with a driven disc (141) facing the driving disc (602); and a first brake shoe (142), located between the driving disc (602) and the driven disc (141), the first brake shoe (142) be connected with the driven disc (141) via an elastic plate (143) for the first brake shoe (142) being constantly against the driven disc (141); so that:

in the case of normal power supply, after the curtain of the fireproof rolling door is wound by the electric motor mechanism (20), a weight of the curtain of the fireproof rolling door constantly acts on the output wheel (191), and a torque generated by the weight of the rolling door is transmitted to the torsional spring (51) through the hollow shaft (15) and the end disc (531), so that the inner diameter of the torsional spring (51) is shrunk to constrict the shaft hub (53) and keep the central rotating shaft (11) in a brake state;

in the case of power failure, the second electromagnetic clutch unit (60) makes the first rotating shaft (13) and the second rotating shaft (17) separate, so that the fireproof rolling door falls down due to the weight of the curtain;

in the case that the curtain of the fireproof rolling door has fallen down, the second electromagnetic clutch unit (60) is electrically powered by the electric energy storage device to connect the first rotating shaft (13) and the second rotating shaft (17), and hence the pull-chain disc (41') can be rotated by puling a pull-chain (43) the inner diameter of the torsional spring (51) is enlarged to release the braking state, to the effect that the rotation of the pull-chain disc (41') is transmitted to the output wheel (191) via the hollow shaft (15), the central rotating shaft (11), the first rotating shaft (13), and the second rotating shaft (17) in sequence so as to wind the curtain of the fireproof rolling door to rise up.

2. The machine mechanism (1) of the door operator as claimed in claim 1, in the housing (10), further comprising a first partition plate (10*a*), a second partition plate (10*b*), and a third partition plate (10*c*), the first partition plate (10*a*) being between the electric motor unit (20) and the first electromagnetic clutch unit (30), the second partition plate (10*b*) being between the first electromagnetic clutch unit (30) and the combination pull-chain disc and brake (40), the third partition plate (10*c*) being between the combination pull-chain disc and brake (40) and the second electromagnetic clutch unit 60; wherein:

a first bush (12) couples the central rotating shaft (11) with the first rotating shaft (13), a right side portion of the first bush (12) being pivoted at the first partition plate (10*a*), a left side portion of the first bush (12) being formed into an end disc (121), on a left end face of which a second brake shoe (122) is provided;

the first electromagnetic clutch unit (30) comprises a first electromagnet (301), secured on the second partition plate (10*b*) and facing the end disc (121); an axial guidance portion (101), formed on the second partition plate (10*b*); and an elastic element (303), accommodated between the guidance portion (101) and the first electromagnet (301);

the hollow shaft (15) passes through the axial guidance portion (101) for being slidable axially; and a braking disc (151) is secured at a right end of the hollow shaft (15) and disposed between the first electromagnet (301) and the end disc (121), the braking disc (151) constantly abutting the second brake shoe (122) of the end disc (121) by the elastic element (303).

3. The machine mechanism (1) of the door operator as claimed in claim 2, wherein on a right side of the accommodating portion (410) of the pull-chain disc (41'), there is provided a portion plate (411) for a bottom thereof;

a protrudent pin (412) is secured at a predetermined radial point on the portion plate (411) with one end of the protrudent pin (412) protruding axially toward a left side of the portion plate (411) into the accommodating portion (410), and the other end extending toward a right side of the portion plate (411) as an extending end (412*a*);

the shaft hub (53) comprises an inner hub (53*a*) and an outer hub (53*b*), the inner hub (53*a*) being pivoted on the portion plate (411), and the outer hub (53*b*) being accommodated in the accommodating portion (410);

on a center portion of the inner hub (53*a*), there is provided a square match bore (532); and a left side end portion of the hollow shaft (15) is correspondingly formed with a square end (152) which is slidably engaged with the match bore (532);

the inner hub (53*a*) is fixed on a left end of the end disc (531) and is located outside of the portion plate (411);

on right end face of the end disc (531), there is provided a circular through slot (5311), being formed along a circumference direction with a predetermined length and in correspondence to the radial position of the protruding pin (412), to receive the extending end (412*a*);

the outer hub (53*b*) is fixed on the third partition plate (10*c*) in a left side;

a movable disc (533) rotatably pivots on the outer hub (53*b*);

the torsional spring (51) having an inner diameter is slidably coiled around the outer hub (53*b*) with two free ends of the torsional spring (51) staggered with a predetermined distance and formed radially and outwardly as protruding portions (511, 511');

from the end disc (531) of the inner hub (53*a*), each top end of a pair of bolt pieces (535, 535') goes through the portion plate (411), and passes by outsides of the two protrudent portions (511, 511') of the torsional spring (51) at predetermined positions outside two bottom ends of the circular slot (5311), and then is fixed on the movable disc (533); and the protrudent pin (412) passes in between the two protrudent portions (511, 511').

4. The machine mechanism (1) of the door operator as claimed in claim 3, wherein two through circular slots (413, 413') corresponding to the two bolt pieces (535, 535') are formed on the portion plate (411) as moving paths within which the two bolt pieces (535 and 535') move.

5. The machine mechanism (1) of the door operator as claimed in claim 4, further comprising a centrifugal braking unit (70), disposed around an outer periphery of the second bush (14), to reduce the rotating motion of the second bush (14).

6. The machine mechanism (1) of the door operator as claimed in claim 5, wherein the electric power energy device is a storage cell.

7. The machine mechanism (1) of the door operator as claimed in claim 6, wherein in the case that the electric motor unit (20) is detached or out of order, the curtain of the fireproof rolling door is wound on or unwound from the winding shaft by a manual operation through the combination pull-chain disc and brake (40).

* * * * *